United States Patent [19]

Fozard et al.

[11] Patent Number: 4,786,266

[45] Date of Patent: Nov. 22, 1988

[54] OPEN SEA TRANSFER OF FLUIDS

[75] Inventors: John W. Fozard; Nigel J. Came; Dennis J. Mottram; Heinz E. Frick, all of Surrey, United Kingdom

[73] Assignee: British Aerospace Public Limited Company, London, England

[21] Appl. No.: 886,220

[22] Filed: Jul. 16, 1986

[30] Foreign Application Priority Data

Jul. 17, 1985 [GB] United Kingdom ..... 8518001

[51] Int. Cl.[4] ..... B63B 22/02

[52] U.S. Cl. ..... 441/5; 114/230; 137/615

[58] Field of Search ..... 441/3–5; 114/230; 137/355.23, 355.24, 355.26, 355.12, 615, 899.2, 899.3; 141/250, 251, 257, 279, 312, 387, 388

[56] References Cited

U.S. PATENT DOCUMENTS

| | | | |
|---|---|---|---|
| 3,332,716 | 7/1967 | Gridley . | |
| 3,700,132 | 10/1972 | Waters . | |
| 3,750,703 | 8/1973 | Arita | 137/615 |
| 3,756,446 | 9/1973 | Macrander . | |
| 3,774,253 | 11/1073 | Lecompte | 441/4 |
| 4,023,517 | 5/1977 | Ryan | 141/279 |
| 4,066,093 | 1/1978 | Egerstrom | 137/615 |
| 4,135,543 | 1/1979 | DeGraaf | 137/615 |
| 4,173,804 | 11/1979 | Duc | 441/4 |
| 4,190,090 | 2/1980 | Tuson | 137/615 |
| 4,281,611 | 8/1981 | Vilain | 441/5 |
| 4,295,771 | 10/1981 | Mehesan, Jr. | 414/5 |
| 4,317,524 | 3/1982 | Andersson | 212/146 |
| 4,523,729 | 6/1985 | Frick | 244/115 |
| 4,530,302 | 7/1985 | Pedersen | 141/279 |

FOREIGN PATENT DOCUMENTS

| | | |
|---|---|---|
| 0096187 | 4/1983 | European Pat. Off. . |
| 260447 | 11/1970 | U.S.S.R. . |
| 1399060 | 6/1975 | United Kingdom . |
| 1591645 | 6/1981 | United Kingdom . |
| 1592983 | 7/1981 | United Kingdom . |
| 2138771 | 10/1984 | United Kingdom . |
| 2163402 | 2/1986 | United Kingdom . |

*Primary Examiner*—Sherman D. Basinger
*Assistant Examiner*—Stephen P. Avila
*Attorney, Agent, or Firm*—Cushman, Darby & Cushman

[57] ABSTRACT

The equipment for the transfer of fluids such as oil or gas from a drilling rig or platform mounted on the seabed to a ship pitching, heaving and yawing in relation thereto includes an interconnection through which fluid flow can take place. The interconnection has two parts, namely a probe 5 and a probe-receiver 4. The two parts are capable of engagement or disengagement on relative fore-and-aft movement. The equipment also includes a hose 6 to pass fluid to and from the interconnection, one part of the interconnection being mounted upon the platform 1 and the other part being carried by an at least partially spaced stabilized gantry 9 mounted upon the receiver vessel 8. One part of the interconnection 4 is mounted by a releasable anchor and has its hose 6 extendable when the anchor is released. The arrangement is such that the receiver vessel can be temporarily placed in an engagement position adjacent to the platform 1 and the parts 4 and 5 of the interconnection so aligned that engagement can be effected. Subsequently, the vessel 8 can be moved away from the platform to a more convenient position, while the interconnection 4 and 5 remain engaged to allow fluid transfer, the extendable hose 6 being paid out accordingly.

10 Claims, 3 Drawing Sheets

OPEN SEA TRANSFER OF FLUIDS

Figure 1:
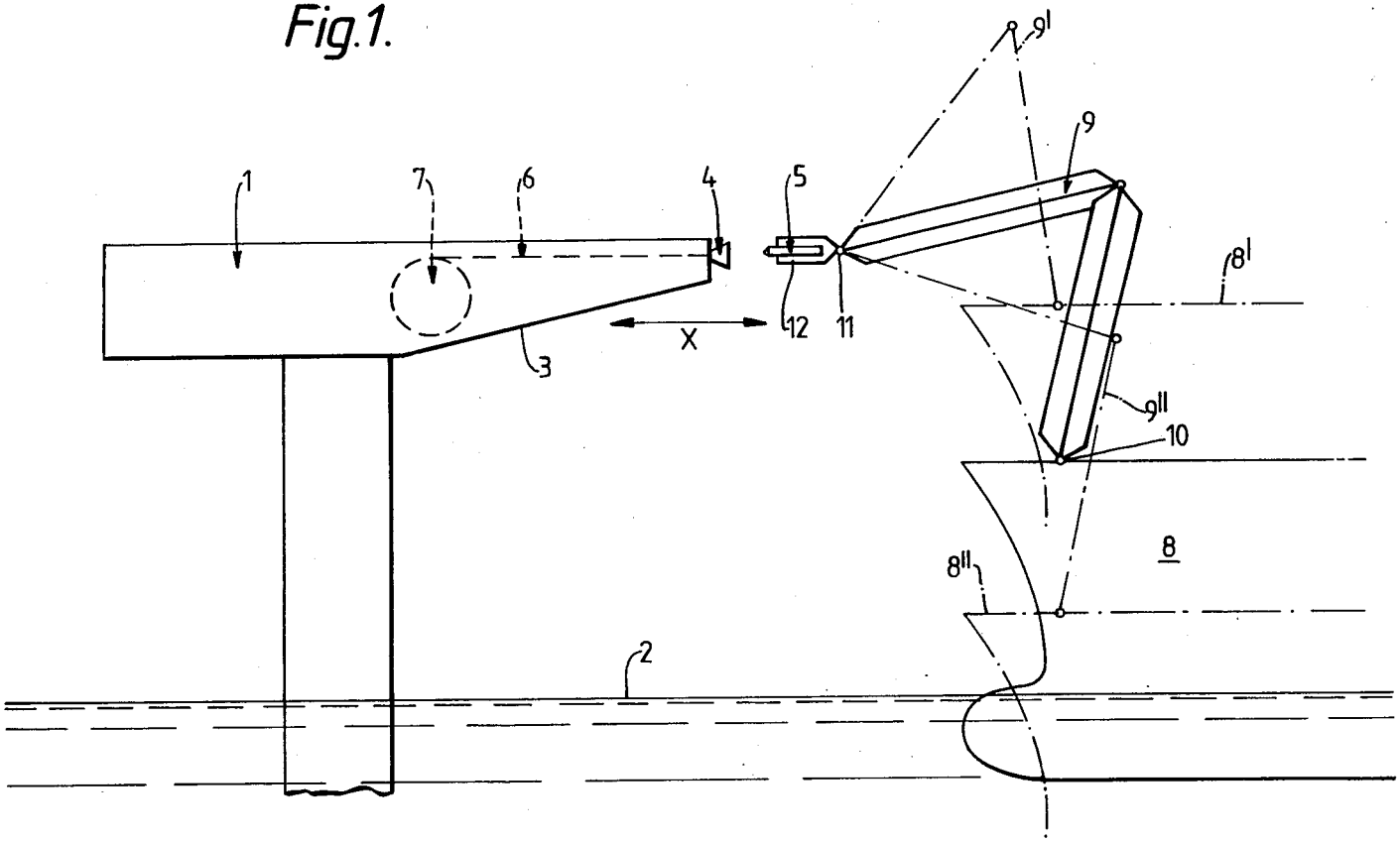

This invention is concerned with the transfer of fluids from an oil or gas platform to a receiver vessel in conditions where the platform is more-or-less fixed but the vessel is moving through a range of several tens of feet in height and/or sway, and through many degrees in both pitch and roll.

Hitherto, a receiver vessel has been manoeuvred alongside the platform and the hose passed from one to the other. Naturally, passing the hose between the platform and the receiver vessel can be a difficult matter in open sea conditions even when the expedient of carrying the hose between the platform and the receiver vessel by means of a picket boat is used. Thus the objectives of the present invention are to provide apparatus on both the receiver vessel and the platform which at least partly automates the process of achieving fluid flow interconnection between the two, which allows the receiver vessel to be so manoeuvred when adjacent the platform that it is under relatively precise control during the period of achieving interconnection, and which allows the receiver vessel to be moved away from the platform when fluid transfer is actually taking place.

According to one aspect of the invention, an arrangement for effecting open sea transfer of fluid (e.g. oil or gas) from a platform to a receiver vessel includes interconnection means through which fluid flow can take place, comprising two parts, a probe and a probe receiver, being capable of engagement or disengagement on relative fore-and-aft movement, hose means to pass fluid to and from the interconnection means, one part of the interconnection means being mounted upon the platform and the other part being carried by an at least partially space stabilised gantry means mounted upon the receiver vessel, one part of the interconnection means being mounted by releasable anchorage means and having its hose means extendable when said anchorage means is released, the arrangement being such that the receiver vessel can be temporarily placed in an engagement position adjacent the platform and the parts of the interconnection means so aligned that engagement can be effected. Subsequently, the vessel can be moved away from the platform to a more convenient position, whilst the interconnection means remains engaged to allow fluid transfer, the extendable hose means being paid-out accordingly.

Preferably one part of the interconnection means is movable with reference to its mounting in a fore-and-aft direction to provide engagement movement. The interconnection means is preferably in the form of an automatic coupling which is self sealing to prevent fluid loss on uncoupling.

Preferably the gantry is mounted upon the receiver vessel at its bow or stern so that its associated part of the interconnection means can project respectively forwardly or rearwardly of the receiver vessel. The receiver vessel can thus be moved in a forwards or rearwards direction toward the platform to the engagement position whereupon the fore-and-afat interconnecting movement can be effected. The receiver vessel can then be subsequently moved away to a more convenient position for the bulk of fluid transfer, having regard to safety and the less rigorous demands on station keeping, for example.

The gantry is preferably arranged to fold down to reduce windage when not in use. Moreover, since it requires only to be space stabilised when the receiver vessel is in or near the engagement position, it can be rendered rigid at other times, e.g. when the receiver vessel is stationed away from the platform, so that the gantry can more easily bear the weight of paid out hose and hose contents.

Figure 2:
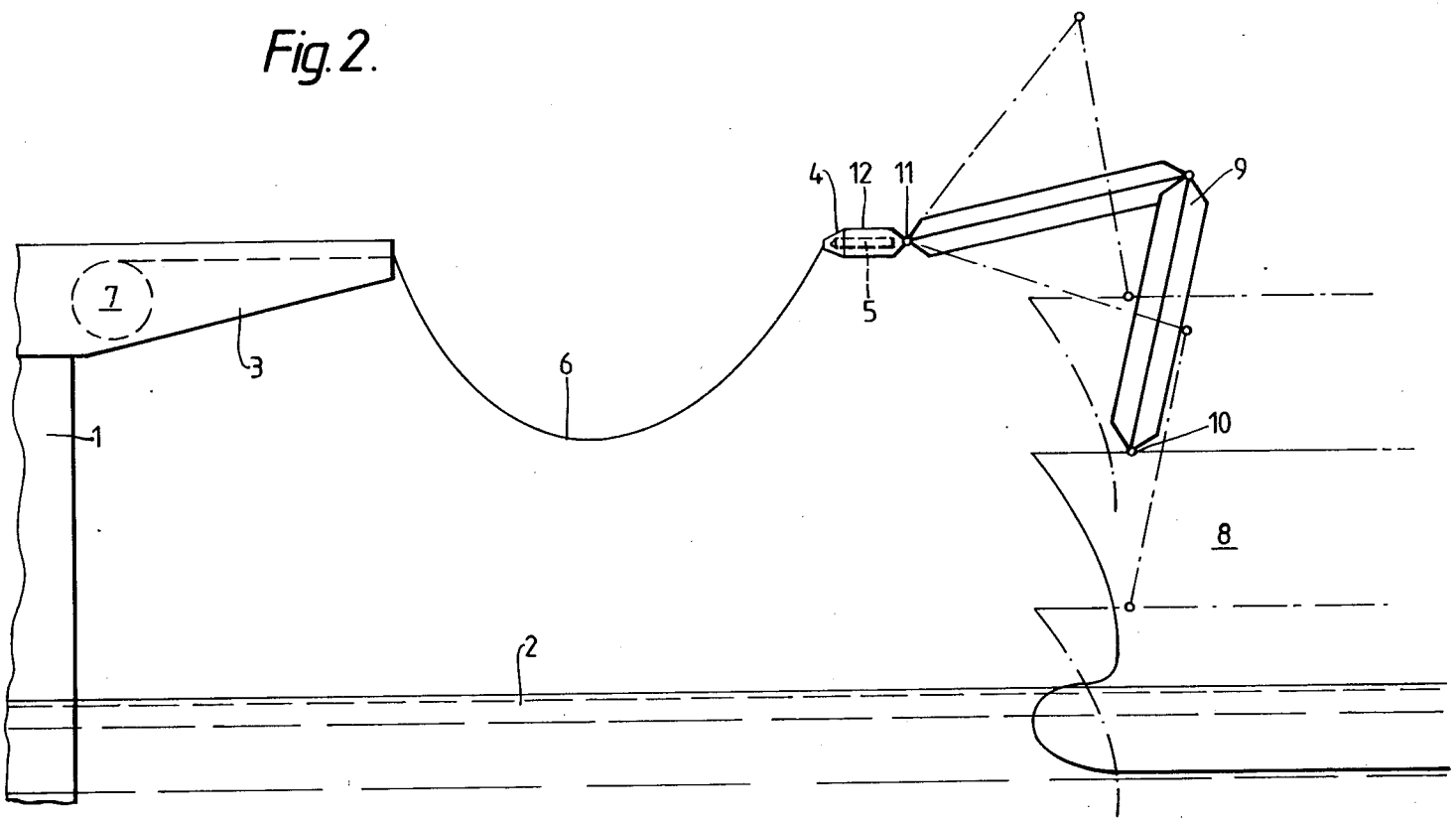
Figure 3:
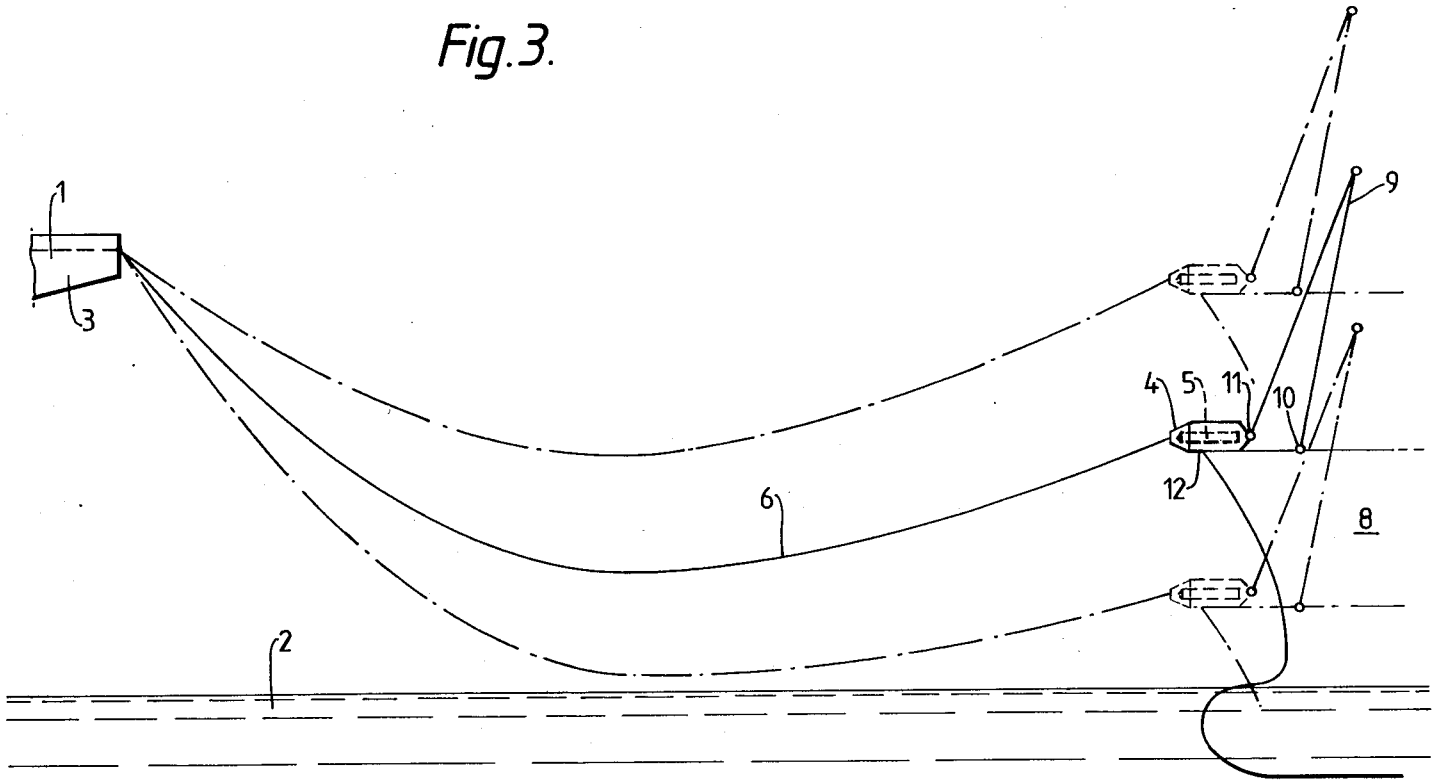

One arrangement for effecting such transference of fluid is described by way of example in the accompanying diagrammatic drawings in which:

FIG. 1 is a side view of a platform and a receiver vessel in station with the platform in an engagement position suitable for fluid transfer engagement, FIG. 2 is a similar view with the receiver vessel subsequent to fluid transfer engagement in an intermediate back-off position, and FIG. 3 is a further similar view with the receiver vessel in a more fully backed-off position.

In the drawings, a platform 1 from which gas or oil is to be transferred protrudes from the sea surface shown nominally at 2. It includes an arm 3 on which is releasably carried a receiving cone 4. This cone 4 is fixedly mounted in the fore-and-aft sense (i.e. in the direction of Arrow X, FIG. 1) so that it can be engaged by a probe 5 capable of fore-and-aft movement to effect such engagement. Subsequent to engagement the cone is released to be carried by the probe. Although temporarily fixed in the fore-and-ast sense, the cone 4 may be tiltable in the pitch or yaw senses to accommodate any residual relative angular movement of the probe.

A mechanism (not shown) is provided which, on engagment of the cone by the probe, locks the two together and also allows the opening of a valve effecting fluid to flow from one to the other immediately or at a time to be chosen. On breaking of the connection, naturally the valve will automatically close. The cone 4 is connected to a source of oil or gas via a hose 6 which is coiled upon a drum 7 so that it can be paid out in a manner to be described.

The bow of a receiver vessel, for example a tanker or gas carrier, to which the fluid from the platform is to be transferred, is shown at 8. Depending upon sea conditions the receiver vessel may move bodily vertically (i.e. heave) between the positions shown generally in broken outline at 8' and 8''. It may also move laterally (i.e. sway) and longitudinally (i.e. surge) and it may also move angularly about pitch, yaw and roll axes.

On its bow, although it can also be mounted upon the stern, the receiver vessel carries a gantry 9 having one end 10 anchored to the receiver vessel and one end 11 free which carries the probe 5 in a mounting 12. The mounting 12 allows the probe to be moved in a fore-and-aft sense with reference to the free end 11 of the gantry so that the cone 4 can be positively engaged. The gantry is articulated and so arranged that probe 5 is at least partially space stabilised, the various movements of the articulated portions to effect this being shown in broken outline 9' and 9'' in side view. The gantry can also move in azimuth to accommodate vessel yawing and sway motions.

The probe is hollow and is connected by a hose (not shown) to processing equipment and thence to storage tanks in the receiver vessel.

The gantry 9 is capable of being locked in position in conditions when space stabilisation is unnecessary. Preferably this is done in a retracted or lowered position, as shown in FIG. 3, so that the gantry can more readily bear the weight of the hose and its contents. The lowered position is also useful to minimise windage when the receiver vessel is in transit.

The arrangement with the gantry mounted on the bow as described can be operated in the following manner.

The receiver vessel, with the gantry 9 extended to the position shown generally in FIG. 1, is manoeuvred towards the platform basically in a forward sense until the receiver vessel reaches an engagement position in which the probe 5 is aligned with and is capable of being inserted into the cone 4. Since the gantry is space stabilised the probe is readily maintained in this position by minor changes in receiver vessel fore-and-aft and/or lateral thrust from its power plant.

The probe 5 is then urged by forward movement relative to its mounting 12 and guided (either manually or automatically) into the cone 4, whereupon locking of the probe to the cone occurs. The probe is then moved aft with respect to its mounting 12 and thereby withdraws the cone 4, which remains attached to the probe 5, from the platform. The receiver vessel itself then backs away from the platform, drawing hose 6 from the drum 7 as shown in FIG. 2. At a given stage, when the free length of hose 6 is sufficient to accommodate relative movement of the receiver vessel and platform, the probe may be no longer space stabilised.

At a later stage, shown in FIG. 3, in which the receiver vessel is further backed-off from the platform, the gantry is rendered rigid, for example by lowering the probe to the deck, to thereby better transfer the loads exerted by the hose 6 and its contents to the receiver vessel. This position of the gantry also reduces windage, and minimises the power requirements of the gantry operating system.

At a chosen stage, the fluid flow valves are opened to effect transfer from the platform to the receiver vessel.

At the end of the transfer operation, the cone 4 is merely released from the probe and the reel 7 used to draw the hose 6 and the cone back to the platform.

Although described with the gantry on the bow of the receiver vessel so that the receiver vessel noses towards the platform and backs away subsequent to engagement, as before described the gantry could alternatively be positioned upon the stern. In this case the receiver vessel would back towards the platform and subsequently move away in a forwards direction. Irrespectively, the azimuthal position of the arm 3 and hence the cone 4 can be arranged such that the receiver vessel when moving toward or away from the platform is generally aligned with the prevailing wind, thus minimising control problems and the hazards associated therewith.

The arrangement has advantage in that the receiver vessel requires only to be moved longitudinally towards and away from the platform and is thus readily controllable. Moreover, the receiver vessel requires its bow or stern to be adjacent the platform in the engagement position only for as long as it takes to effect engagement of the probe and cone, and can subsequently be moved away and stood off at a more convenient and safe distance from the platform during the prolonged period of fluid transfer.

Since the gantry can be collapsed or stowed when not in use, it has minimal effects on windage and forward or rearward view over the receiver vessel except during the engagement operation.

We claim:

1. An arrangement for effecting open sea transfer of fluid (e.g. oil or gas) from a platform to a receiver vessel, comprising:

interconnection means through which fluid flow can take place, said interconnection means comprising two parts, a probe and a probe receiver, being capable of engagement or disengagement on relative fore and aft movement;

one said part of the interconnection means being mounted initially upon the platform, the other said part being carried by an at least partially space-stabilised gantry means mounted upon the receiver vessel;

one said part of the interconnection means being mounted by releasable anchorage means and having extendible hose means for passing fluid to and from said interconnection means connected thereto and such that said hose means is extendible when said anchorage means is released;

the other said part of the interconnection means having non-extendible hose means connected thereto for passing fluid from and to said interconnection means;

the arrangement being such that the receiver vessel can be temporarily placed in an engagement position adjacent to the platform and the two said parts of the interconnection means so aligned that engagement can be effected, and subsequently, the vessel can be moved away from the platform to a more convenient position, releasing said anchorage means, permitting the two said parts of the interconnection means to remain engaged and the extendible hose means to be paid-out accordingly to allow fluid transfer.

2. An arrangement for effecting open sea transfer of fluid as claimed in claim 1, wherein:

one said part of the interconnection means is moveable with reference to its mounting in a fore-and-aft direction to provide engagement movement.

3. An arrangement for effecting open sea transfer of fluid claimed in claim 1 or claim 2 and wherein the interconnection means is preferably in the form of an automatic coupling which is self-sealing to prevent fluid loss on uncoupling.

4. An arrangement for effecting open sea transfer of fluid as claimed in claim 3 and wherein the gantry is mounted upon the receiver vessel at its bow or stern and so that its associated part of the interconnection means can project respectively forward or rearwardly the receiver vessel.

5. An arrangement for effecting open sea transfer of fluid as claimed in claim 4 and wherein the gantry is arranged to fold down to reduce windage when not in use.

6. An arrangement for effecting open sea transfer of fluid as claimed in claim 4 and wherein the gantry is capable of being rendered rigid whenever, for example, the receiver vessel is stationed away from the platform or of being at least partially stabilized whenever, for example, the receiver vessel is brought to an engagement position adjacent to the platform immediately prior to or after engagement of the parts of the interconnection means.

7. An arrangement for effecting open sea transfer of fluid as as claimed in claim 3 and wherein one part of the interconnection means comprises a receiving cone releasably carried on an arm attached to the platform and the other part of the interconnection means comprises a probe capable of fore-and-aft movement and carried on the gantry mounted upon the receiver vessel so that subsequent to the engagement the cone is released from the arm to be carried by the probe.

8. An arrangement for effecting open sea transfer of fluid as claimed in claim 7 and wherein the cone when attached to the arm is fixedly mounted in the fore-and-aft sense but is tiltable in the pitch or yaw sense to accommodate any residual relative angular motion of the probe when engaged initially therewith.

9. An arrangement for effecting open sea transfer of fluid as claimed in claim 7 and wherein the hose means comprises a hose coiled upon a drum mounted for rotation with respect to the arm, said hose being connected to the cone.

10. An arrangement for effecting the open sea transfer of fluid as claimed in claim 4 and wherein the gantry is articulated and so arranged that the part of the interconnection means carried thereon is at least partially stabilized and so that the gantry can be collapsed or stowed when not in use.

* * * * *